US009334665B2

(12) United States Patent
Fons

(10) Patent No.: US 9,334,665 B2
(45) Date of Patent: May 10, 2016

(54) DEVICE AND METHOD FOR POSITIONING SHELL PARTS

(75) Inventor: Gerrit Jan Fons, Oostzaan (NL)

(73) Assignee: J&D BEHEER B.V., Zaandam (NL)

( * ) Notice: Subject to any disclaimer, the term of this patent is extended or adjusted under 35 U.S.C. 154(b) by 996 days.

(21) Appl. No.: 13/502,255

(22) PCT Filed: Oct. 15, 2010

(86) PCT No.: PCT/NL2010/050682
§ 371 (c)(1),
(2), (4) Date: Apr. 25, 2012

(87) PCT Pub. No.: WO2011/046440
PCT Pub. Date: Apr. 21, 2011

(65) Prior Publication Data

US 2012/0217364 A1 Aug. 30, 2012

(30) Foreign Application Priority Data

Oct. 16, 2009 (NL) ..... 2003649

(51) Int. Cl.
*A47G 1/10* (2006.01)
*E04H 7/30* (2006.01)
*E04H 7/06* (2006.01)

(52) U.S. Cl.
CPC ... *E04H 7/30* (2013.01); *E04H 7/06* (2013.01)

(58) Field of Classification Search
USPC ..... 269/43
See application file for complete search history.

(56) References Cited

U.S. PATENT DOCUMENTS 2,861,277 A * 11/1958 Hermann ..... 220/642
3,015,883 A * 1/1962 Brown ..... 29/271
3,131,908 A * 5/1964 Payton ..... 254/89 H
3,182,958 A 5/1965 Peterzon-Arbella (Continued)

FOREIGN PATENT DOCUMENTS

GB 00948672 2/1964
GB 1208464 10/1970
WO 0049249 8/2000

OTHER PUBLICATIONS

International Searching Authority, International Search Report for PCT/NL2010/050682, Jan. 28, 2011, 3 pages.

(Continued)

*Primary Examiner* — Lee D Wilson
*Assistant Examiner* — Alvin Grant
(74) *Attorney, Agent, or Firm* — Hoyng Rokh Monegier LLP; Ramin Amirsehhi; David P. Owen

(57) ABSTRACT

Device and method for the mutual positioning of shell parts. Such shell parts can be used for constructing a large cylinder, for example a silo. The shell parts are provided with end flanges which extend at right angles thereto. Once the shell parts have been brought into the correct position, the end flanges are connected to one another in any suitable way. It is proposed to position the shell parts and/or end flanges with respect to one another in the desired position by arranging supporting rollers on the side where there are no end flanges. On the other side, clamping rollers are used which are at an angle to one another. A combination of in each case a supporting roller and a clamping roller provides both the correct mutual positioning of the shell parts with respect to one another and the pressing against one another of the shell parts.

15 Claims, 3 Drawing Sheets

(56) References Cited

U.S. PATENT DOCUMENTS

| | | | | | |
|---|---|---|---|---|---|
| 3,209,504 | A | * | 10/1965 | Berg | 52/479 |
| 3,239,927 | A | * | 3/1966 | Hozak | 29/429 |
| 3,425,614 | A | * | 2/1969 | Clark | 228/49.3 |
| 3,546,831 | A | * | 12/1970 | Kratky et al. | 52/115 |
| 4,561,222 | A | * | 12/1985 | Fons | 52/197 |
| 4,656,793 | A | * | 4/1987 | Fons | 52/98 |
| 4,716,836 | A | * | 1/1988 | Hardt | 104/15 |
| 4,718,208 | A | * | 1/1988 | Fons | 52/192 |
| 4,836,714 | A | * | 6/1989 | Matiere | 405/134 |
| 4,898,497 | A | * | 2/1990 | Behr | 405/154.1 |
| 5,009,052 | A | * | 4/1991 | Welch | 52/745.01 |
| 5,356,067 | A | * | 10/1994 | Leduc | 228/44.5 |
| 5,535,938 | A | * | 7/1996 | Leduc | 228/212 |
| 5,644,946 | A | * | 7/1997 | Weschler | 72/457 |
| 5,910,186 | A | * | 6/1999 | Weschler | 72/447 |
| 6,108,391 | A | * | 8/2000 | Deaver et al. | 376/262 |
| 6,398,457 | B2 | * | 6/2002 | Baugh | 405/170 |
| 6,435,495 | B1 | * | 8/2002 | Radbourne et al. | 269/48.1 |
| 6,915,943 | B2 | * | 7/2005 | Laing | 228/212 |
| 8,895,887 | B2 | * | 11/2014 | Trapp et al. | 219/78.01 |

OTHER PUBLICATIONS

Search Report for priority application NL2003649 issued on May 28, 2010.

International Preliminary Report on Patentability for PCT/NL2010/050682 issued on Apr. 17, 2012.

* cited by examiner

DEVICE AND METHOD FOR POSITIONING SHELL PARTS

The present invention relates to a device for the mutual positioning of two shell parts.

It is known from the prior art to construct silos or other structures by connecting shell parts to one another. An example thereof can be found in Dutch patent 1011315 in the name of Jansens & Dieperink B. V.

Therein, the shell parts are provided with end flanges extending along the periphery. The end flanges of adjacent shell parts are placed in the desired position with respect to one another and are attached to one another in any suitable way, for example by stapling. Thereafter, sealing of the shell parts is provided, preferably after the complete container or other structure has been finished. This sealing can be effected by means of welding.

It has been found that positioning the relatively large shell parts with respect to one another is time-consuming. In the prior art, clamping and gripping tongs are used for this purpose and by setting these with respect to one another, the correct position of shell parts which are to be attached to one another can be achieved. It has been found that this is labour-intensive and does not ensure a very accurate mutual positioning in all circumstances.

It is an object of the present invention to avoid these drawbacks.

This object is achieved by providing a device according to the present invention.

The present invention proposes to support the shell parts from the "inside" and to exert a positioning force on the shell parts from the "outside". This force acts towards both forcing the shell parts to be connected to one another towards the supporting member and forcing the end flanges of the respective shell parts towards one another.

It will be understood that in particular bringing the shell parts into the same horizontal position can also be achieved by applying a force to the supporting member.

In this description, the terms vertical, horizontal, inside and outside are used. It will be understood that these terms are to be read in the context of the present description and are not limiting in any way. All this depends on the embodiment of the structure which is joined together by means of the above-described device.

The various members for positioning the shell parts with respect to one another can be embodied in any conceivable way. They may have a relatively smooth end which comes into contact with the shell parts. According to a particular embodiment of the invention, these are embodied as roller members. As a result thereof, it is possible to achieve the successive series of desired positions automatically, once the end flanges of the shell parts have been clamped in a correct position at a location with respect to one another, by carrying out a rotating movement of the roller members. As has been described above, once the correct mutual positioning of the shell parts has been achieved, this mutual position will be fixed by means of, for example, bolting, stapling, welding or another connection technique. Subsequently, a final sealing can be provided by means of cementing, welding, etc.

In a particular embodiment of the present invention, the supporting member consists of two supporting rollers. Therein, each of the rollers is dedicated to one of the shell parts. This makes it possible to place these rollers in a different position and/or to apply a different pressing force thereon.

In particular if curved shell parts have to be positioned with respect to one another, the curvature of both shell parts may not be identical. If these are curved, for example, according to a circle, it is possible for these circles to have a different diameter. These are preferably relatively small differences and this difference in diameter can always be compensated for along the entire circumference of the shell parts in the same way by varying the mutual positioning of the supporting rollers. In addition, the present invention makes it possible to adjust the mutual rotation position, for example with cylindrical shell parts. That is to say if the cylindrical shell parts are placed vertically on top of one another, the vertical distribution of the shell parts with respect to one another can be set accurately. This can be achieved in a simple and very accurate way by means of the rollers.

The clamping members as well as the supporting rollers may be fitted displaceably with respect to the frame of the device. It is possible to embody one of the clamping members so as to be displaceable in the direction of the boundary line between the shell parts and the other clamping member to be displaceable in a direction perpendicular thereto. Obviously, it is also possible to displace one or both clamping members in the direction of the angle with respect to which they have been fitted.

Displacement of the members with respect to the frame can be carried out in any conceivable way, e.g. hydraulically, pneumatically, by means of threaded rods and the like. All this will be carried out in a coordinated manner by means of a control unit for the different supporting members. It is possible to measure any variations in dimension between the different shell parts on site and on the basis thereof to position the different members with respect to the frame. In addition, in the case of such variations in diameter, it is possible to limit the deflection of one of the members, for example one of the clamping members, in the direction of the boundary line between the shell parts, as a result of which an even distribution of the difference in diameter along the circumference of the boundary line of the respective shell part can be achieved.

The frame can comprise any conceivable structure by means of which engagement of two shell parts from two opposite sides is possible. Preferably, this is U-shaped. According to a particular embodiment, it consists of a double U-shaped structure between which the various members are placed.

The invention also relates to the combination of the above-described device and an auxiliary device by means of which the shell parts can be supported further. In particular if large shell parts are used, for example for structures having a diameter greater than 3 meters, further support is desirable. In addition, according to a particular embodiment of the invention, this further support is achieved in such a way that engagement between the shell parts only takes place at the location of the above-described device. Consequently, the friction between the end flanges is as little as possible and the end flanges can be moved to the desired mutual position with respect to one another using relatively little force.

The present invention also relates to a method for positioning the end flanges of two adjacent shell parts with respect to one another, comprising supporting said shell parts on the side facing away from said end flanges by means of a supporting member which absorbs a force in the direction of the boundary line between said shell parts into a frame, wherein an opposite force is introduced into said frame by two clamping members which are at an angle to one another and are fitted on the side of said end flanges on said frame, each of said clamping members exerting a pressing force on said end flanges which is directed in an opposite direction.

The invention will be explained in more detail below with reference to an exemplary embodiment illustrated in the drawing, in which.

Figure 1:
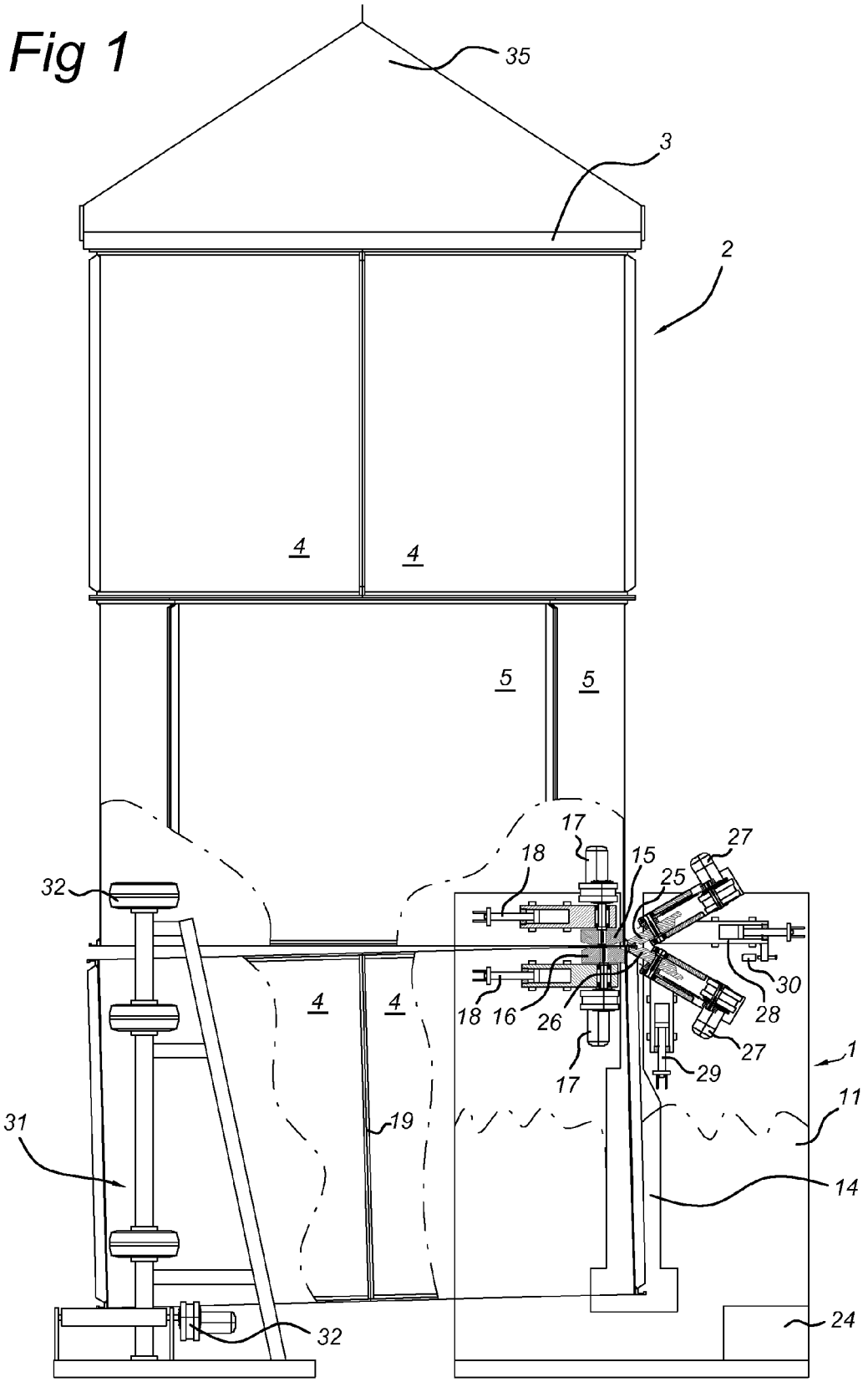
FIG. 1 shows a partially constructed silo with the device according to the invention arranged therein.
Figure 2:
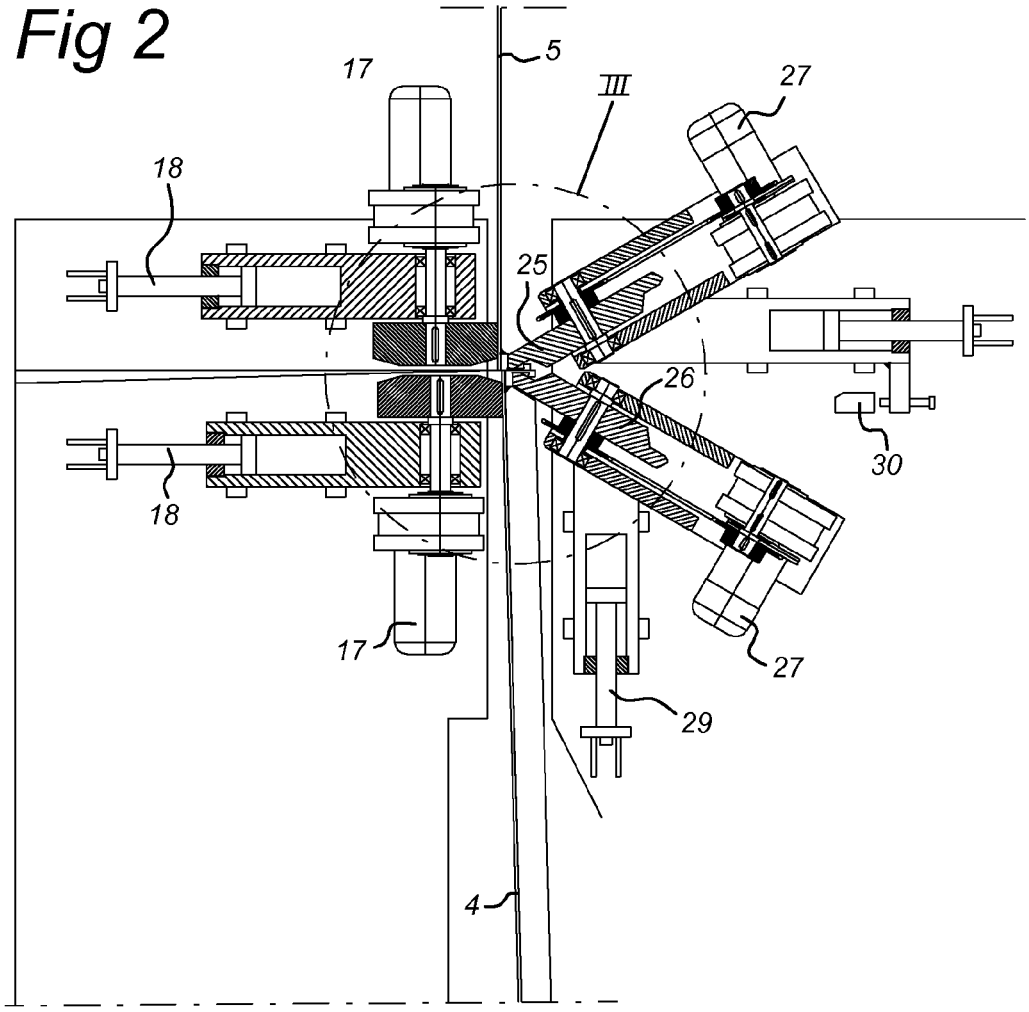
FIG. 2 shows a detail of the device from FIG. 1.

In FIG. 1, a device according to the invention is designated overall by reference numeral 1. It is combined with a silo 2 which is under construction. This silo consists of a roof part 3 and a number of shell parts 4 and 5, respectively. A number of shell parts 4 and 5, respectively, connected together, form a cylinder. It will be understood that the present invention can be used with any kind of structure which is composed of shell parts which are to be connected to one another.

Figure 3:
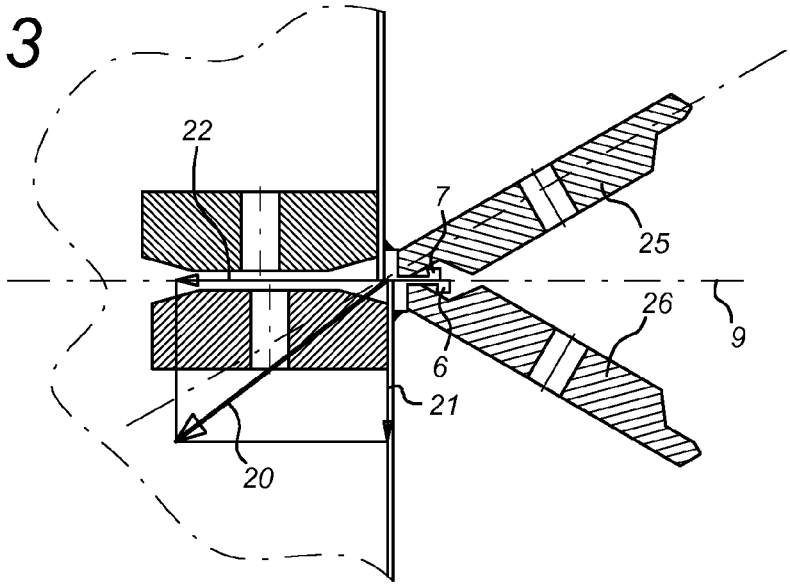
FIG. 3 shows a detail of FIG. 2 which shows how the end flanges are pressed against one another.

As can be seen, in particular in FIG. 3, each shell part is provided with an end flange which extends on all sides. The end flange of shell part 4 is denoted by reference numeral 6 and the end flange of shell part 5 by reference numeral 7. The end flanges of the shell parts are to be placed on top of one another along the boundary line 9. After the end flanges 6, 7 have been brought into the correct position with respect to one another, they are (temporarily) fixed with respect to one another, for example by stapling, bolting or welding.

If the shell parts are relatively large, as will be the case with silos, they are not easy to handle. However, it is very important that the end flanges are placed accurately with respect to one another. As, moreover, such silos are generally constructed in situ since they are too large to be transported, the production circumstances will not always be favourable. In practice, in the prior art, a large number of labourers is usually hired in order to assist with the correct mutual positioning. Such mutual positioning not only comprises the relative positioning of the end flanges in the "horizontal" direction, but also clamping the end flanges against one another in order to provide the mutual connection.

The present invention makes the manual alignment of the shell parts 4 and 5 (largely) redundant and makes it possible to bring about all this mechanically by means of device 1.

Figure 4:
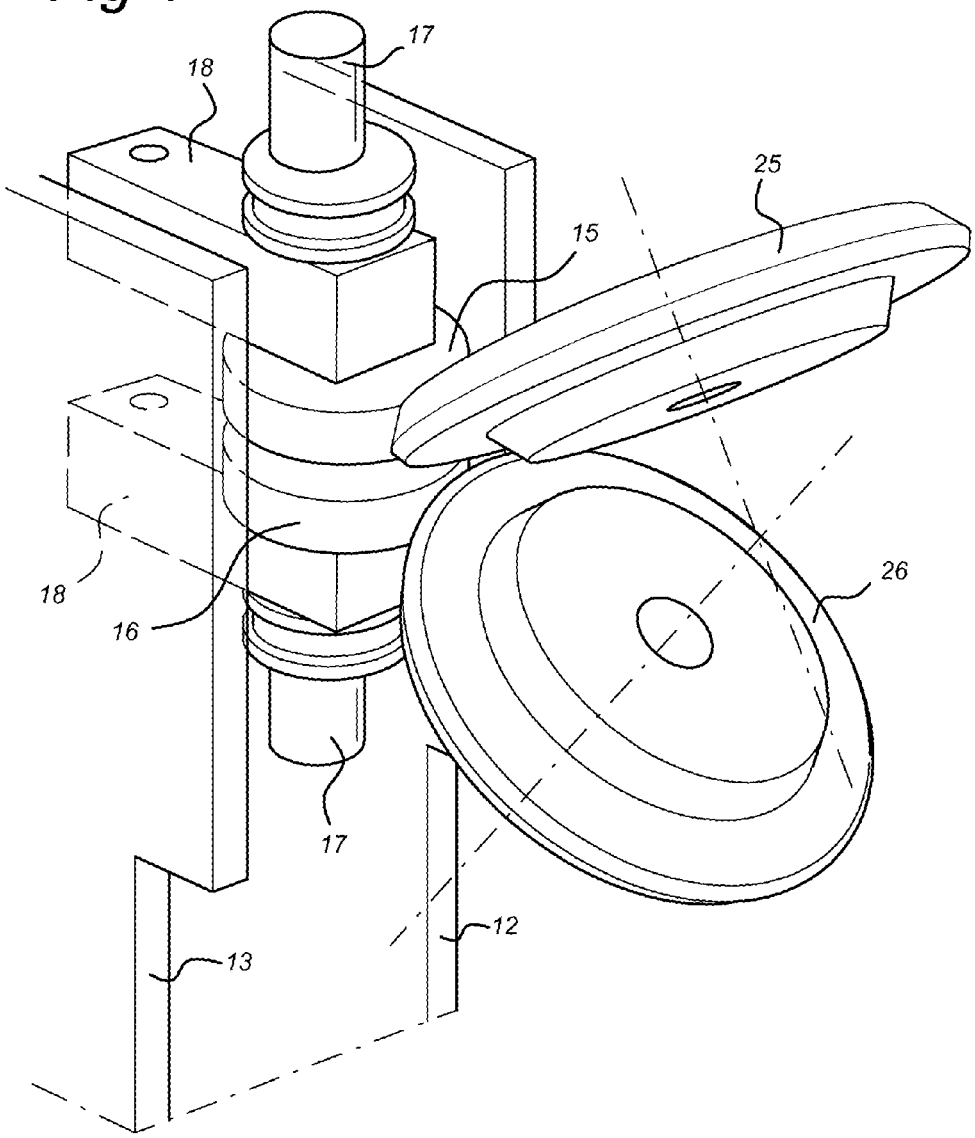
FIG. 4 diagrammatically shows a part of the device from the earlier figures.

Device 1 consists of a U-shaped frame 11, wherein an opening 14 is delimited within the U. As can be seen in FIG. 4, in a preferred embodiment, frame 11 is composed of two spaced-apart plates 12 and 13, between which the various components to be described below are accommodated.

One "leg" of the U is provided with a first supporting roller 15 and a second supporting roller 16. Each supporting roller can be rotatably driven by means of in each case one motor 17 and the mutual positioning of the supporting roller with respect to the frame can be set in the direction of boundary line 9 by means of in each case one worm drive 18. The worm drives and motors are actuated by a control 24.

The other "leg" of the frame is provided with a first clamping roller 25 and a second clamping roller 26. Each clamping roller is rotatably driven via a transmission by a motor 27. Clamping roller 25 is (as seen in the drawing) horizontally displaceable, that is to say in the direction of the boundary line 9, by means of worm drive 28. Clamping roller 26 is vertically displaceable by means of worm drive 29. Here, the worm drives and motors are also actuated by means of a control 24.

In addition to device 1, there is an auxiliary device 31 which is provided with various positioning rollers and functions to support the shell parts 4.

The above-described device works as follows:

The upper part of the silo consisting of the roof 3 and the two cylindrical rings composed of shell parts 4 and 5, respectively, is provided. The silo is, for example, suspended by the roof from a crane which is present on the construction site. The sling used is denoted by reference numeral 35. Thereafter, a subsequent cylinder ring consisting of a number of interconnected shell parts 4 is placed under the cylindrical ring consisting of shell parts 5. This is carried out by means of device 1 and auxiliary device 31. Therein, auxiliary device 31 and device 1 are placed in such a manner with respect to the upper part of the silo that the end flanges 6 of shell part 4 and the end flange 7 of shell part 5 only contact one another at the location of device 1. After these end flanges 6 and 7 have been pressed against one another in the manner to be described below, the mutual position thereof is directly fixed, for example by means of stapling. By rotating both the part of the silo which has already been produced and the cylindrical ring 4 which is situated underneath, the cylindrical ring 4 is connected to the end flange 7 of the cylindrical ring 5 above it via the end flange 6. It will be understood that the various shell parts 4 have been connected to one another along the vertical line 19 beforehand. This connection can also be produced by means of end flanges situated at the vertical line 19.

According to the present invention, the shell parts 4 and 5 to be connected are accommodated within the opening 14 of the U-shaped frame 11. From the inside of the silo to be produced, the shell parts 4 and 5 are supported by means of the supporting rollers 15 and 16. As there may be differences in diameter between the cylindrical ring formed by the shell parts 5 and the cylindrical ring formed by the shell parts 4, the supporting rollers 15 and 16 may be in a different horizontal position. That is to say that, in a situation as shown in FIG. 3, if the ring consisting of shell parts 5 has a smaller diameter than the ring consisting of shell parts 4, this smaller diameter can be evenly distributed over the end flanges by moving the first supporting roller 15 further to the left, thus producing a regular cylindrical part.

From the other side, that is to say in the illustrated example the outside, the end flanges are pressed both against the first supporting roller 15 and the second supporting roller 16 as well as against one another via the shell parts 4 and 5.

This is achieved by the presence of the first and second clamping rollers 25 and 26 which are at an angle with respect to one another. As a result thereof, it is possible to exert a pressing force on the supporting rollers 15 and 16 and press the end flanges against one another, so that, as soon as the correct position has been reached, these end flanges can be fixed to one another.

In FIG. 3, the force which acts on the first clamping roller 25 is resolved into components. This force, which is indicated by arrow 20, can be resolved into a horizontal component 22 and a vertical component 21. The second clamping roller will generally have a different horizontal component 22 in the same direction and the vertical component thereof will be directed opposite to component 21. By suitably actuating the various worm drives 18, 28 and 29, it is possible to accurately set the correct position of the end flanges. If it is found beforehand that there are differences in diameter between the ring parts composed of the shell parts 4 and 5, respectively, the desired mutual position can be determined and subsequently these differences can be limited, inter alia with stop 30 for the horizontal displacement of the first clamping roller. The drawing shows that the second clamping roller is vertically displaced by means of worm drive 29.

By means of this structure, it is possible, after correct setting, to readily achieve the mutual positioning of the end parts at the location where the mutual position thereof is fixed.

After the ring consisting of the shell parts 4 has been connected to the ring consisting of the shell parts 5 in the above manner, a subsequent ring can be connected to the shell parts 4 by lifting.

In addition, it is possible, after the silo has been produced in this manner to provide further sealing between the end flanges. This may be effected, for example, by welding and it may be advantageous in this case to tilt the silo.

It will be understood that after reading the above, many variants are possible. Thus, it is possible to in each case use two supporting rollers (that is to say a total of four supporting rollers) instead of a single supporting roller 15 and 16, respectively, on one side of the respective shell part and to engage the centre of the opposite side in between by means of the first and second clamping rollers, respectively.

In addition, many further variants are conceivable which are covered by the scope of the attached claims.

The invention claimed is:

1. A device (1) for the mutual positioning of two shell parts (4, 5) which rest on one another via end flanges (6, 7), said device comprising:

a frame (11) having an opening (14) adapted to receive two shell parts (4, 5) with end flanges (6, 7), wherein on one side of said opening on said frame, a supporting member (15, 16) for shell parts is arranged and, on the other side of said opening, at a location of said supporting member, two adjacent clamping members (25, 26) are arranged, wherein one of said members (15, 16, 25, 26) is displaceably arranged with respect to said frame, each of said clamping members has an engagement end for engaging the end flange of a shell part, wherein said clamping members (25, 26) are fitted at such an angle with respect to one another that, upon displacement of said member (15, 16, 25, 26) with respect to said frame (11) each clamping member (25, 26) exerts a force on said supporting member (15, 16) with a first component (22) directed along a boundary line (9) of said clamping members (25, 26) towards said supporting member (15, 16) and a second component (21) at right angles thereto, wherein said second components are directed towards one another in order to place the end flanges of the shell parts against one another.

2. The device according to claim 1, wherein one or more of said members (15, 16; 25, 26) is a roller member.

3. The device according to claim 2, wherein said roller member is provided with a rotation motor (17, 27).

4. The device according to claim 1, wherein said supporting member (15, 16) is arranged so as to be displaceable with respect to the frame in the direction of said boundary line (9).

5. The device according to claim 1, wherein said supporting member (2) comprises a pair of supporting rollers (15, 16) which are arranged one above the other.

6. The device according to claim 1, wherein one of said clamping members (25) is arranged so as to be displaceable with respect to the frame in direction of said boundary line (9).

7. The device according to claim 1, wherein one of said clamping members (26) is arranged so as to be displaceable with respect to said frame in a direction at right angles to said boundary line (9).

8. The device according to claim 1, wherein said frame comprises a U-shaped frame.

9. An assembly comprising a device (1) according to claim 1, and further comprising an auxiliary device (31) for supporting shell parts in a further location.

10. A method for positioning end flanges (6, 7) of two adjacent shell parts (4, 5) with respect to one another, comprising:

supporting said shell parts on a side facing away from said end flanges using a supporting member (15, 16) which absorbs a force in the direction of the boundary line (9) between said shell parts into a frame (11), introducing an opposite force into said frame (11) by two clamping members (25, 26) which are at an angle to one another and are arranged on a side of said end flanges (6, 7) on said frame (11), each of which clamping members exerting a pressing force (21) on said end flanges which is directed in an opposite direction.

11. The method according to claim 10, wherein said member comprises a roller member (15, 16; 25, 26) and is rotatably driven.

12. The method according to claim 10, wherein said shell parts comprise cylinder parts having end flanges which extend at right angles to a cylinder wall.

13. The method according to claim 12, wherein, during the positioning, a mutual position of the end flanges (6, 7) is fixed by connecting the latter.

14. The method according to claim 13, wherein, after said end flanges have been connected, the shell parts are sealed with respect to one another.

15. The method according to claim 10, wherein said shell parts are supported further, in such a manner that said end flanges (6, 7) are only placed against one another at said members.

* * * * *